US008454188B1

(12) United States Patent
Harrison et al.

(10) Patent No.: US 8,454,188 B1
(45) Date of Patent: Jun. 4, 2013

(54) IN-ROADWAY WARNING LIGHT APPARATUS WITH MOISTURE PROTECTION

(75) Inventors: Michael A Harrison, Santa Rosa, CA (US); Dave Michaelson, Santa Rosa, CA (US)

(73) Assignee: Light Guard Systems, Inc., Santa Rosa, CA (US)

( * ) Notice: Subject to any disclaimer, the term of this patent is extended or adjusted under 35 U.S.C. 154(b) by 783 days.

(21) Appl. No.: 12/542,550

(22) Filed: Aug. 17, 2009

Related U.S. Application Data

(60) Provisional application No. 61/189,068, filed on Aug. 15, 2008.

(51) Int. Cl.
*E01F 9/00* (2006.01)

(52) U.S. Cl.
USPC ..... 362/153.1; 362/245; 362/249.02; 362/311.02; 362/339; 404/12

(58) Field of Classification Search
USPC ..... 362/153.1, 249.02, 311.02, 329, 362/330, 339, 244, 245; 404/12
See application file for complete search history.

(56) References Cited

U.S. PATENT DOCUMENTS 4,382,274 A * 5/1983 De Backer et al. ..... 362/153
6,726,398 B2 * 4/2004 Hamakawa et al. ..... 404/13

* cited by examiner

*Primary Examiner* — Stephen F Husar
(74) *Attorney, Agent, or Firm* — Larry D. Johnson

(57) ABSTRACT

An in-roadway warning light (IRWL) apparatus incorporates a dove prism in the light beam path to embed an air gap inside the IRWL signal head housing and ensure that light from the LEDs is projected in the desired direction, while simultaneously providing moisture protection for the LEDs and associated electronics in the housing.

25 Claims, 4 Drawing Sheets

IN-ROADWAY WARNING LIGHT APPARATUS WITH MOISTURE PROTECTION

CROSS REFERENCE TO RELATED APPLICATIONS

The present application claims the benefit of the filing date of U.S. Provisional Patent Application Ser. No. 61/189,068, filed Aug. 15, 2008, and hereby incorporated by reference herein.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to lights and lighting fixtures, and more particularly to an improved in-roadway warning light (IRWL) apparatus with enhanced moisture protection for the internal LEDs and electronics.

BACKGROUND INFORMATION AND DISCUSSION OF RELATED ART

One problem associated with in-roadway warning light signal heads results from the requisite internal air gap needed to keep the light pattern in the desired direction. Moisture in this air gap can cause condensation to form on the inside of the lens or window of the signal head. While this condensation is often merely an aesthetic problem, it can also potentially affect the LEDs and associated electronics in the signal head, and may decrease confidence in the product from the purchasers standpoint.

U.S. Pat. No. 6,384,742 to Harrison discloses a traffic warning system which alerts approaching vehicle traffic to the presence of a pedestrian in a crosswalk. The system includes a plurality of surface mounted lights partially embedded in and placed across a roadway. The lights are activated by the pedestrian, either by manual switch or by a sensor, before he enters the crosswalk. Once activated, the flashing lights warn drivers of approaching vehicles that a pedestrian may have entered the crosswalk, and that caution should be exercised.

U.S. Pat. No. 6,597,293 to Harrison describes a traffic warning system which alerts approaching vehicle traffic to an intersection stop requirement. The system includes a plurality of above-pavement, surface mounted lights, installed in a fashion similar to currently used road reflectors, and which are partially embedded in a roadway and placed across the roadway, e.g., adjacent to and parallel with the existing stripes or stop bars designating an intersection, and constructed so that they are impervious to vehicle traffic over them. Once activated, the lights flash in the direction of oncoming traffic, and emanate directly from the roadway, to warn drivers of approaching vehicles that a stop may be required at the intersection, and that caution should be exercised.

U.S. Pat. No. 6,683,540 to Harrison teaches a traffic warning system which alerts approaching vehicle traffic to the approach of a train in a crossing. The system includes a plurality of surface mounted lights partially embedded in and placed across a roadway. Once activated, the flashing lights warn drivers of approaching vehicles that a train is approaching, and that caution should be exercised.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention provides an improved in-roadway warning light (IRWL) apparatus incorporating a dove prism in the light beam path to embed an air gap inside the IRWL signal head housing and ensure that light from the LEDs is projected in the desired direction, while simultaneously providing moisture protection for the LEDs and associated electronics in the housing. The inventive signal head design incorporates the dove prism as the window or lens of the signal head, and the LEDs are potted behind the prism with an air gap between the LEDs and the leading edge of the prism. This strengthens the overall unit and eliminates moisture problems inside of the signal head.

This arrangement places the air gap deeper into the center of the signal head, and should any moisture be present, it will not be as evident from the exterior of the signal head as the light is reflected and refracted through the solid dove prism. This enhances durability and virtually eliminates the potential for condensation to form inside the signal head.

It is therefore an object of the present invention to provide a new and improved signal head for an in-roadway warning light.

It is another object of the present invention to provide a new and improved signal head with moisture resistance.

A further object or feature of the present invention is a new and improved signal head with improved durability.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
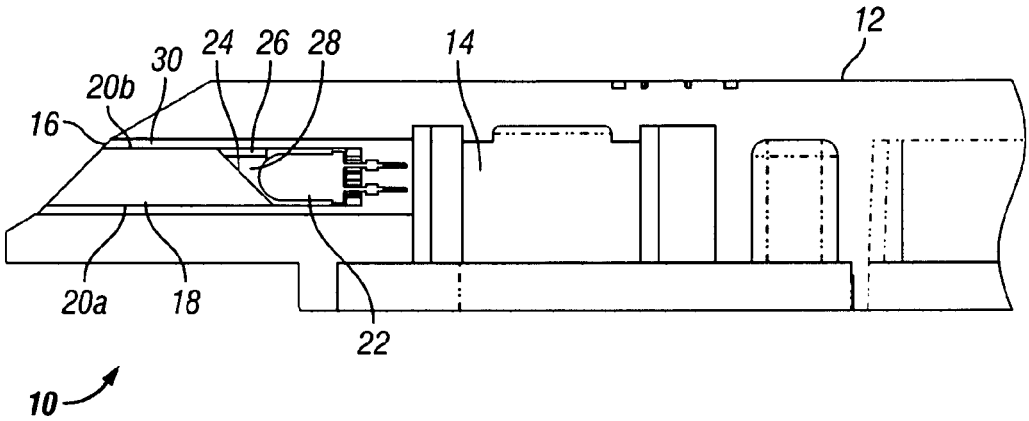
FIG. 1 is a side elevation section view of an in-roadway warning light apparatus of this invention.

Referring to FIGS. 1 through 9, wherein like reference numerals refer to like components in the various views, there is illustrated therein a new and improved moisture protected in-roadway warning light apparatus, generally denominated 10 herein.

FIG. 1 is a side elevation section view of an in-roadway warning light apparatus 10 of this invention. IRWL 10 includes a housing 12, an internal electronics cavity 14, and at least one aperture or light tube 16. Dove prism 18, preferably constructed of polycarbonate or like durable, transparent material, and with internally reflecting mirrored top and bottom surfaces 20*a*, 20*b*, forms the window or lens of the apparatus. At least one LED 22 (e.g., having a 15 degree beam width, 594 Nm) is positioned inside the light tube 16, separated from the leading edge 24 of the prism 18 by white polycarbonate spacer 26 to define an air gap 28. Solid epoxy potting 30 encapsulates the light structure of the prism 18, spacer 26, and LED 22, as well as the electronics cavity 14, in the housing 12 to insulate all the components from the harsh road environment.

Figure 2:
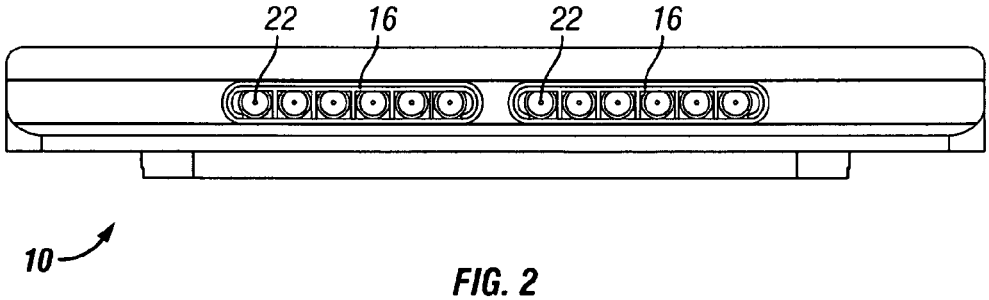
FIG. 2 is a front elevation view showing the relative scale for the LEDs and light tubes of the apparatus.

FIG. 2 is a front elevation view showing the relative scale of a plurality of LEDs 22 housed within a pair of light tubes 16 in the apparatus. In a preferred embodiment, two horizontal sets of five LEDs each are arranged in two adjacent light tubes 16. Overall width of the IRWL 10 may be on the order of seven inches.

Figure 3:
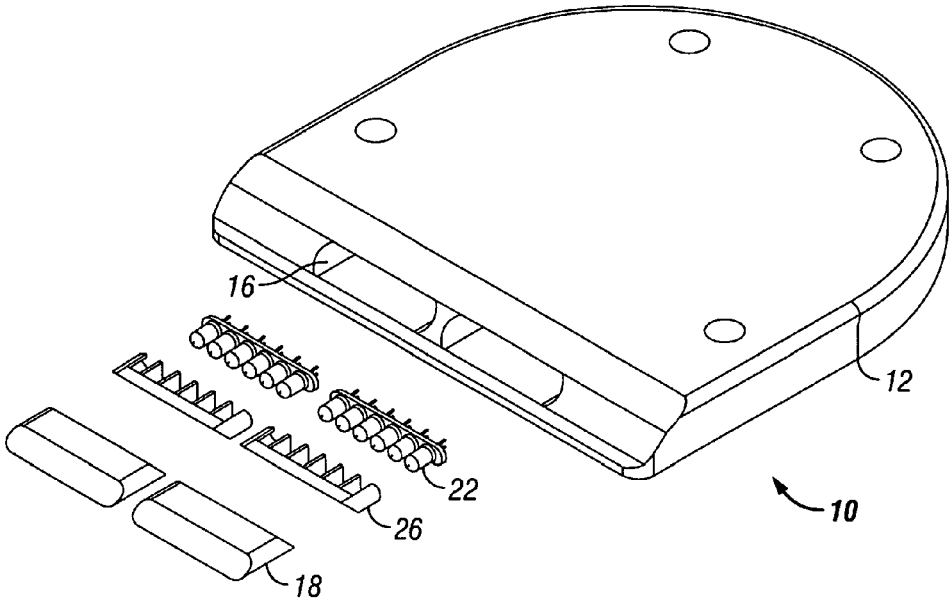
FIG. 3 is an exploded isometric view of the general assembly of the apparatus.

FIG. 3 is an exploded isometric view of the general assembly of the apparatus. The light structure consisting of dove prisms 18, spacers 26, and LEDs 22 is fabricated and inserted into the light tubes 16, and then the entire light structure is potted in place encapsulating it within the housing 12, or otherwise embedded solidly in the housing in a molded process.

Figure 4:
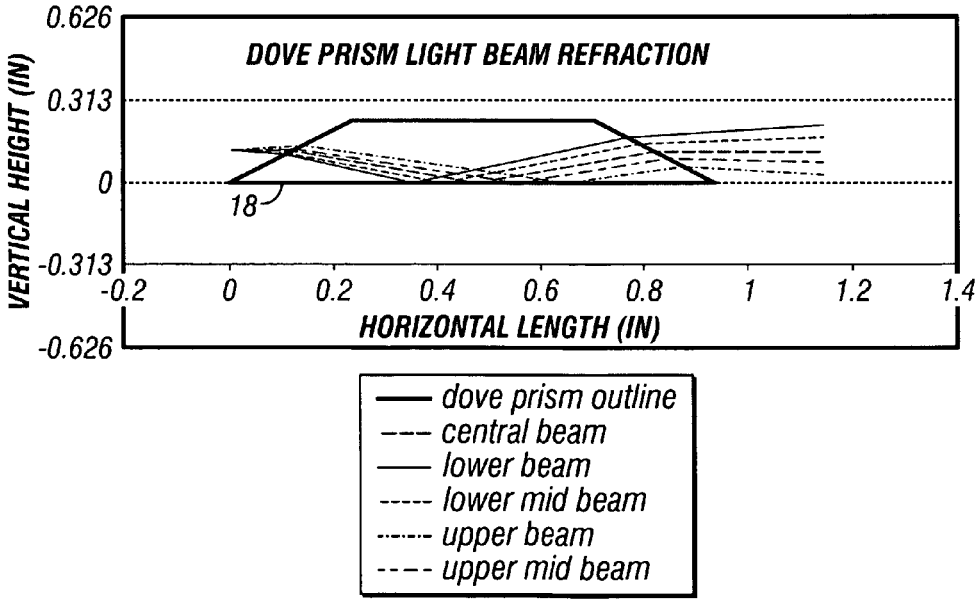
FIG. 4 is an optical reference graphic illustrating the dove prism light beam refraction.

FIG. 4 is an optical reference graphic illustrating the dove prism light beam refraction. A 15 degree light beam from the LED(s) enters the dove prism 18 from the left, and is refracted and reflected to exit from the right of the dove prism with the same 15 degree beam width.

Figure 5:
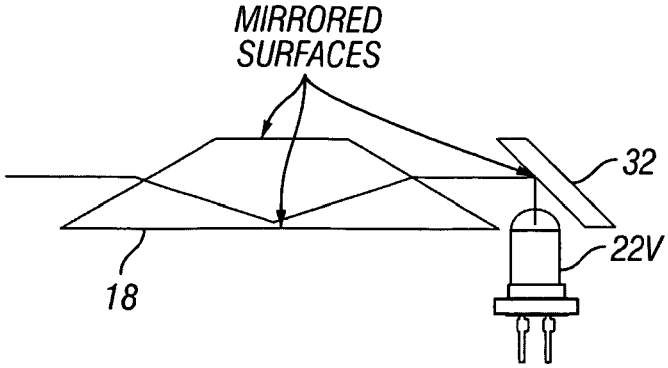
FIG. 5 is a side elevation view of an alternate embodiment of the inventive apparatus, utilizing a vertically oriented light source.

FIG. 5 is a side elevation view of an alternate embodiment of the inventive apparatus, utilizing a vertically oriented light source. Mirror 32 reflects the light beam from vertically oriented LED 22V to enter prism 18 on the horizontal, where it is reflected and refracted to exit the prism toward a motorist as described supra. The vertical orientation of the LEDs within the housing may be advantageous in particular signal head constructions.

Figure 6:
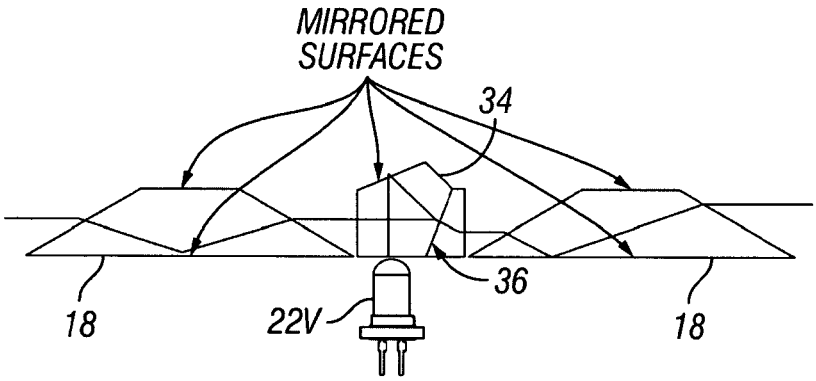
FIG. 6 is a side elevation view of a further alternate embodiment of the inventive apparatus, utilizing a single vertical light source to produce bidirectional light beams.

FIG. 6 is a side elevation view of a further alternate embodiment of the inventive apparatus, utilizing a single vertical light source to produce bidirectional light beams. Beam splitting penta-prism 34 (with a partial reflective coating 36) reorients the vertical direction of the LED light beam from LED 22V to a bidirectional horizontal beam (50/50), then each dove prism 18 transmits the light toward the motorist.

Figure 7:
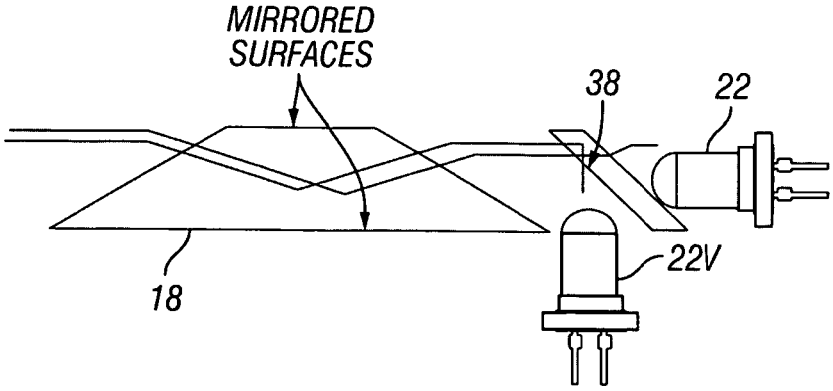
FIG. 7 is a side elevation view of a further alternate embodiment of the inventive apparatus, utilizing two independent light sources.

FIG. 7 is a side elevation view of a further alternate embodiment of the inventive apparatus, utilizing two independent light sources. A 45 degree angle "two way" or partial mirror 38 reorients the vertical direction of the light beam from LED 22V (which may be of a first specific color) to horizontal, then dove prism 18 transmits that light from its exit surface toward the motorist. The partial mirror 38 also allows the horizontal direction of the light beam from LED 22 (which may be of a second specific color) to transmit through to the prism, and then toward the motorist. In this arrangement, vertical LED 22V and horizontal LED 22 are preferably not illuminated simultaneously, but rather sequentially, to enable different color light (e.g., green and red) to be selectively transmitted toward the motorist, without unnecessarily expanding the size or footprint of the IRWL signal head.

Figure 8:
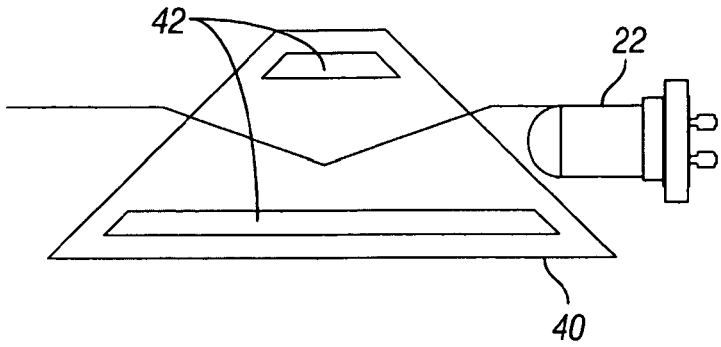
FIG. 8 is a side elevation view of a further alternate embodiment of the inventive apparatus, utilizing a dove prism with integral air gaps.

FIG. 8 is a side elevation view of a further alternate embodiment of the inventive apparatus, utilizing a dove prism with integral air gaps. Snell's Law indicates that without an air boundary in contact with the parallel surfaces of the dove prism (e.g., due to the waterproof structural encapsulate), or internally reflective mirror surfaces on the parallel surfaces, Total Internal Reflection (TIR) cannot occur. Without TIR, light entering the prism will be trapped and absorbed, and not exit the prism as desired. Dove prism 40 incorporates internal air gaps 42 to achieve the requisite reflectivity.

Figure 9:
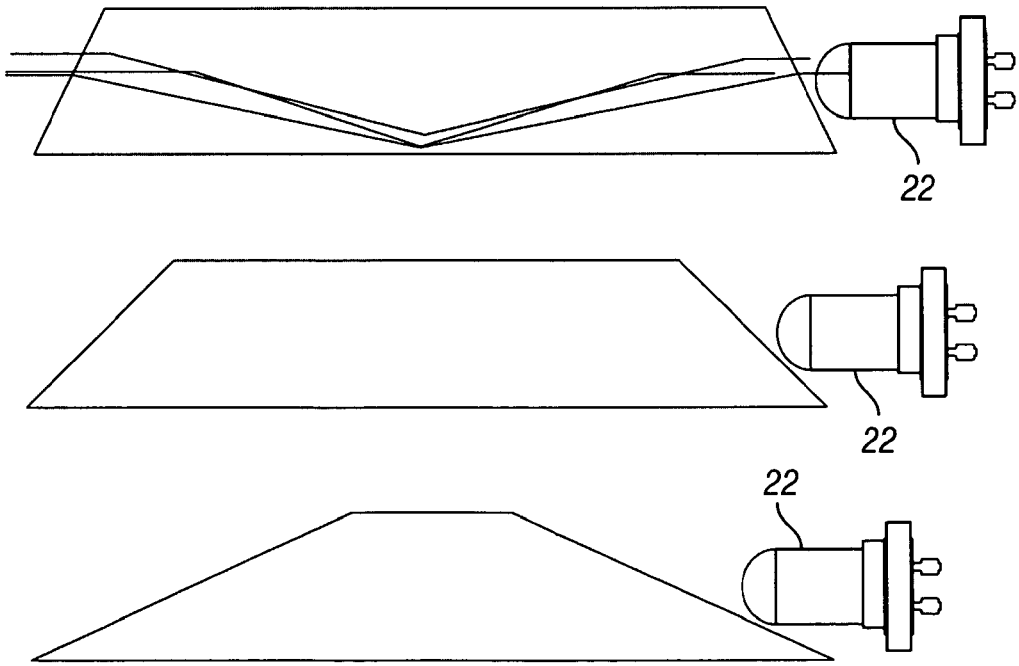
FIG. 9 is a side elevation view illustrating dove prisms having alternate angular surfaces.

FIG. 9 is a side elevation view illustrating dove prisms having alternate angular light entrance and exit surfaces. While 90 degrees is the optimal angle for total internal reflection to maximize light transmission through a medium, 45 degrees is the optimal angle for a dove prism to minimize the optical losses associated with multiple internal reflections. All angles between 0 and 90 degrees can be used for a dove prism, where the prism length and height are appropriately adjusted to accommodate optical performance, focal length, and light fixture housing practical and physical constraints.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed is:

1. An in-roadway warning light apparatus comprising:

a signal head having a housing with a light aperture, at least one LED located in said light aperture, and an electronics cavity; and a dove prism in said light aperture adjacent said at least one LED to permit transmission of light from said at least one LED and out of said signal head, while isolating said at least one LED and said electronics cavity from the road environment, wherein said dove prism includes internally reflecting mirrored top and bottom surfaces.

2. The in-roadway warning light apparatus of claim 1 wherein said at least one LED is separated from said dove prism by an air gap spacer.

3. The in-roadway warning light apparatus of claim 1 wherein said dove prism is encapsulated in said signal head housing.

4. The in-roadway warning light apparatus of claim 1 wherein said at least one LED emits a selected light beam width.

5. The in-roadway warning light apparatus of claim 4 wherein said prism maintains said selected beam width.

6. The in-roadway warning light apparatus of claim 4 wherein said selected beam width is approximately 15 degrees.

7. The in-roadway warning light apparatus of claim 1 further including a mirror to reflect light from said at least one LED into said dove prism.

8. The in-roadway warning light apparatus of claim 1 wherein said at least one LED is oriented perpendicular to the parallel surfaces of said dove prism.

9. The in-roadway warning light apparatus of claim 1 further including a beam-splitting prism to redirect at least some portion of the light from said at least one LED to a second dove prism.

10. The in-roadway warning light apparatus of claim 1 further including a partial mirror to reflect light from said at least one LED into said dove prism.

11. The in-roadway warning light apparatus of claim 10 further including a second LED behind said partial mirror to direct light from said second LED to said dove prism.

12. The in-roadway warning light apparatus of claim 11 wherein said at least one LED and said second LED are of different colors.

13. The in-roadway warning light apparatus of claim 1 wherein said dove prism includes internal air gaps.

14. An in-roadway warning light apparatus comprising:

a signal head having a housing with a light aperture, at least one LED located in said light aperture, and an electronics cavity; and a dove prism in said light aperture adjacent said at least one LED to permit transmission of light from said at least one LED and out of said signal head, while isolating said at least one LED and said electronics cavity from the road environment, wherein said at least one LED emits a selected light beam width of approximately 15 degrees.

15. The in-roadway warning light apparatus of claim 14 wherein said dove prism includes internally reflecting mirrored top and bottom surfaces.

16. The in-roadway warning light apparatus of claim 14 wherein said at least one LED is separated from said dove prism by an air gap spacer.

17. The in-roadway warning light apparatus of claim 14 wherein said dove prism is encapsulated in said signal head housing.

18. The in-roadway warning light apparatus of claim 14 wherein said prism maintains said selected beam width.

19. The in-roadway warning light apparatus of claim 14 further including a mirror to reflect light from said at least one LED into said dove prism.

20. The in-roadway warning light apparatus of claim 14 wherein said at least one LED is oriented perpendicular to the parallel surfaces of said dove prism.

21. The in-roadway warning light apparatus of claim 14 further including a beam-splitting prism to redirect at least some portion of the light from said at least one LED to a second dove prism.

22. The in-roadway warning light apparatus of claim 14 further including a partial mirror to reflect light from said at least one LED into said dove prism.

23. The in-roadway warning light apparatus of claim 22 further including a second LED behind said partial mirror to direct light from said second LED to said dove prism.

24. The in-roadway warning light apparatus of claim 23 wherein said at least one LED and said second LED are of different colors.

25. The in-roadway warning light apparatus of claim 14 wherein said dove prism includes internal air gaps.

* * * * *